United States Patent [19]

Rossow

[11] Patent Number: 5,038,813

[45] Date of Patent: Aug. 13, 1991

[54] PNEUMATIC STARTER DEVICE

[76] Inventor: David E. Rossow, 7112 Aldredge, Swartz Creek, Mich. 48473

[21] Appl. No.: 526,460

[22] Filed: May 21, 1990

[51] Int. Cl.[5] ..... F15B 13/06

[52] U.S. Cl. ..... 137/110; 91/446

[58] Field of Search ..... 137/110, 111; 91/446, 91/468

[56] References Cited

U.S. PATENT DOCUMENTS

| | | | |
|---|---|---|---|
| 3,215,236 | 11/1965 | Pensa . | |
| 3,222,997 | 12/1965 | Blatt et al. . | |
| 3,470,694 | 10/1969 | Budzich . | |
| 3,536,093 | 10/1970 | DiNonno . | |
| 3,592,216 | 7/1961 | McMillen . | |
| 3,780,755 | 12/1973 | Matsuda | 137/110 |
| 4,402,254 | 9/1983 | Petrimaux et al. . | |

*Primary Examiner*—Alan Cohan

*Attorney, Agent, or Firm*—Gifford, Groh, Sprinkle, Patmore and Anderson

[57] ABSTRACT

A device is provided for controlling the initial pressurization of a pneumatic system having a pressure supply line with an inlet end and a tail end and at least one pneumatic actuator in the system. The device includes a pneumatic valve having a first and second inlet port and an outlet port. The valve is movable between a first position in which a first fluid passageway connects the first inlet port to the outlet port, and a second position in which a second fluid passageway connects the second inlet port to the outlet port. A user variable orifice is connected in series between the source of pneumatic pressure and the first inlet while the source is fluidly connected directly to the second inlet. Similarly, the outlet from the valve is connected to the inlet end of the pressure supply line of the pneumatic system. A biasing member urges the valve towards its first position while a pneumatic switch switches the valve to its second position whenever the pressure at the tail end of the pressure supply line exceeds a user selected pressure.

3 Claims, 1 Drawing Sheet

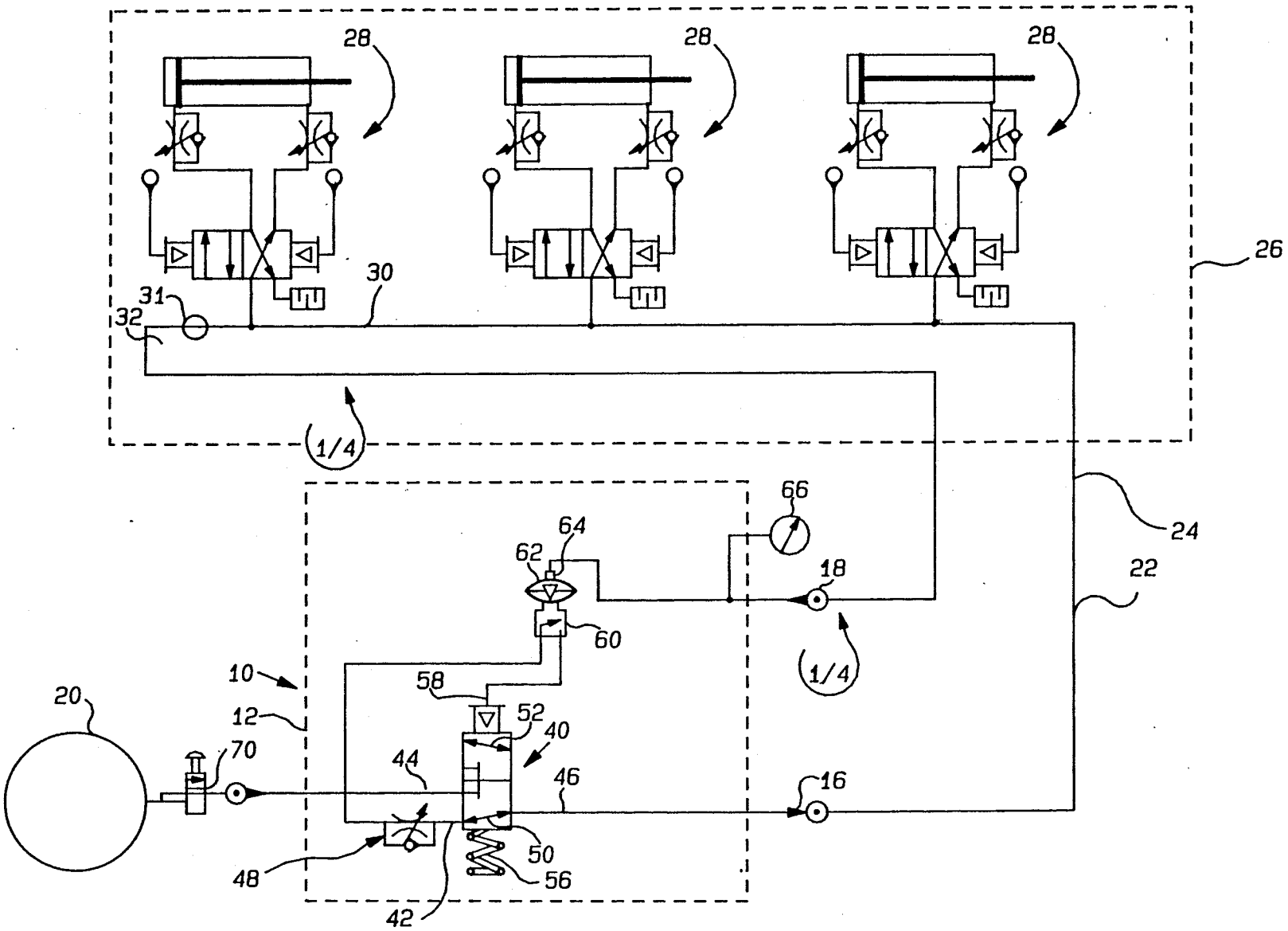
26
24
22
28
28
28
18
1/4
16
66
60
64
62
40
46
52
50
56
58
44
42
48
30
1/4
10
12
70
31
32
20

PNEUMATIC STARTER DEVICE

BACKGROUND OF THE INVENTION

1. Field of the Invention

The present invention relates generally to a pneumatic starter device for controlling the initial pressurization of a pneumatic system.

II. Description of the Prior Art

Pneumatic systems of the type used in shops and manufacturing facilities typically comprise a plurality of pneumatically operated devices each having an inlet port and an exhaust port. A source of pneumatic pressure is fluidly connected to the pneumatic devices, typically through a common supply line. This supply line has an inlet end adapted for connection to the air pressure source, and a tail end.

One problem with the previously known pneumatic system occurs when the system is initially charged with pneumatic pressure as would occur, for example, at the beginning of the manufacturing day. Oftentimes, one or more pneumatic actuators have either drifted out of position or were intentially moved because of required maintenance or set up procedure. Consequently, upon the application of the pneumatic pressure to the system, these pneumatic actuators move back to their at rest position at uncontrolled speeds whenever the air pressure is reapplied. This can result in destructive forces and velocities and can cause, for example, tools left on fixtures to become flying projectiles. Similarly, fixtures that are not bolted down can be knocked off the machine while bolts can be sheared off and expensive tooling can be otherwise damaged.

In order to minimize the destructive forces and velocities which can occur when the pneumatic pressure is reapplied to the system following a system shut down, a previously known pneumatic starter device is disclosed in U.S. Pat. No. 4,402,254 to Petrimaux et al. The Petrimaux et al. patent discloses a pneumatic starter device which is connected in series between the source of pneumatic pressure and the inlet to the supply line for the pneumatic system. The tail end of tho air pressure supply line is connected as a pilot pressure to the starter device.

In operation, the Petrimaux et al. pneumatic starter device provides a restricted orifice during the initial pressurization of the pneumatic system. Whenever the pressure at the pilot port to the starter device exceeds a preset amount, the Petrimaux device valve switches to a second position in which an unrestricted port is fluidly connected in series between the pneumatic source and the fluid system.

The previously known Petrimaux device, however, is disadvantageous in two different respects. First, the Petrimaux device provides an orifice having a fixed restriction during the initial system repressurization. Since the orifice is fixed in size, the initial system pressurization can take a very long time until system pressurization is achieved. Conversely, in a less complex pneumatic device, the pressurization from the restricted port may occur too rapidly.

A second disadvantage of the previously known Petrimaux device is that the fluid pressure at the pilot port in which the Petrimaux pneumatic valve switches from its restricted to its unrestricted fluid passageway is fixed and, therefore, not user adjustable. Again, since the switching pressure is not adjustable, the fixed switching pressure of this previously known device can result in an unnecessarily long period of time for recharging the pneumatic system while, in other cases, the valve means is switched too rapidly.

Summary of the Present Invention

The present invention provides a pneumatic starter device which overcomes all of the above mentioned disadvantages of the previously known devices.

In brief, the pneumatic starter device of the present invention comprises a pneumatic valve having two inlet ports and an outlet port. A biasing means normally urges the valve to a first position in which a first passageway fluidly connects one inlet port with the outlet port. Conversely, in its second position, the valve means includes a second passageway which fluidly connects the second fluid inlet port to the outlet port.

The outlet port from the pneumatic valve is fluidly connected to the air pressure supply line inlet of the pneumatic system. Conversely, both pneumatic inlets of the valve are connected to the source of pneumatic pressure.

However a restricted orifice is also fluidly connected in series between the source of pneumatic pressure and the first inlet port on the pneumatic valve. Furthermore, this orifice is a variable orifice which can be adjusted by the user.

The pneumatic valve also includes a pilot port which switches the valve from its first to its second position whenever the pressure at the pilot valve exceeds a preset amount. Furthermore, with the valve member in its second position, the second unrestricted fluid passageway is fluidly connected in series between the source of pneumatic pressure and the pneumatic system.

A second, normally open pneumatic valve is connected in series between the source of pneumatic pressure and the pilot port to the first pneumatic valve. When the second valve is open, the first valve remains in its first position so that only a restricted air flow is provided to the system. Conversely, when the second valve closes, pressure from the source is applied to the pilot port thereby actuating the first valve to its second position in which unrestricted air flow is provided to the system. In order to move the second valve from its open to its closed position, a diaphragm actuator is connected to the tail end of the air pressure supply line in the fluid system. Furthermore, the pressure at which the diaphragm switch actuates the second pneumatic valve to its closed position is user settable and thus can be varied as desired by the user.

Consequently, unlike the previously known devices, the present invention provides both a variable orifice, as well as a variable pressure in which the first pneumatic valve is switched from its first, restricted position to its second, unrestricted position thereby obtaining greater flexibility than the previously known devices.

Brief Description of the Drawing

A better understanding of the present invention will be had upon reference to the following detailed description when read in conjunction with the accompanying drawing, which is a schematic view illustrating a preferred embodiment of the present invention.

Detailed Description of a Preferred Embodiment of the Present Invention

With reference to the drawing, a preferred embodiment of the pneumatic starter device 10 of the present invention is thereshown. The starter device 10 includes a housing 12, illustrated diagrammatically, having an inlet port 14, an outlet 16 and a pressure feedback port 18. The inlet port 14 is connected to a source 20 of pneumatic pressure. Typically the pneumatic pressure is at 100 or 125 psi.

The outlet port 16 from the starter device 10 is fluidly connected by a line 22 to the inlet of a supply line 24 of a pneumatic system 26,. The pneumatic system 26 has at least one, and preferably a plurality, of fluid actuators 28. Furthermore, each of the fluid actuators 28 includes an inlet connected to a supply line 30 so that the supply line 30 supplies each of the pneumatic actuators 28 with pneumatic pressure.

A pressure sensing signal line 32 is fluidly connected from the tail end 31 of the supply line 30 at the last pneumatic actuator 28 in the pneumatic system 26. This pressure sensing line 32 is fluidly connected to the pilot port 18 on the housing 10 for a purpose to be subsequently described.

The pneumatic starter device 12 includes a first pneumatic valve 40 having two inlet ports 42 and 44 and an outlet port 46. The outlet port 46 is directly fluidly connected to the housing port 16 and thus to the inlet of the supply line 24 of the pneumatic system 26.

Similarly, the second inlet port 44 is directly fluidly connected to the housing inlet 14, and thus to the pneumatic pressure source 20. Conversely, a variable orifice 48 is fluidly connected in series between the housing port 14 and the first inlet port 42 on the pneumatic valve 40. Such variable orifices 48 are well known in the art so that a further description thereof is unnecessary.

The pneumatic valve 40 includes a valve member movable between a first position, illustrated in the drawing, in which a first fluid passageway 50 fluidly connects the first valve inlet 42 with the outlet 46. Conversely, with the valve member in its second position, a second fluid passageway 52 between the second valve inlet 44 and the valve outlet 46. This second fluid passageway 52 is unrestricted so that, with the valve 40 in its second position, the air flow is unrestricted from the pneumatic source 20 to the pneumatic system 26.

A biasing means 56 normally urges the valve 40 to its first position. The pneumatic valve 40, however, includes a pilot port 58 so that, whenever the fluid pressure at the pilot port 58 exceeds a preset value, the pneumatic valve 40 switches to its second position. Furthermore, the pneumatic pressure at the pilot port 58 and which the valve switches from its first to its second position is a value less than the pneumatic pressure at the pneumatic source 20.

A second, normally open pneumatic valve 60 is connected in series between the housing port 14 and the pilot port 58 on the pneumatic valve 40. A diaphragm actuator 62 is associated with the second valve 60 for moving the second valve 60 to its closed position whenever the pressure at a control port 64 to the diaphragm actuator 62 exceeds a predetermined pressure. This predetermined pressure, however, is user adjustable and typically can be adjusted for the range of 10–58 psi. Such diaphragm operated pneumatic valves with variable pressure switching points are well known in the art so that a further description thereof is unnecessary.

The control port 64 on the diaphragm actuator 62 is fluidly connected to the feedback port 18 on the housing 12. Additionally, a pressure gauge 66 is preferably connected to the housing port 18 which provides an indication of the pneumatic pressure at the supply line 30 at the final pneumatic actuator 28'. In operation, and assuming that the pneumatic system 26 has been shut down and, therefore, purged of pneumatic pressure, the pressure on the supply line 30 in the pneumatic system 28 is essentially at atmospheric pressure so that the pressure at the housing feedback port 18 is also at atmospheric pressure. Consequently, the second pneumatic valve is in its open position so that the first pneumatic valve 40, in turn, is in its first position. With the pneumatic valve 40 in its first position, the variable orifice 48 is fluidly connected in series between the housing port 14 and the housing outlet port 16.

Assuming that pneumatic pressure is applied from the source to the housing inlet port 14, for example by closure of a pneumatic switch 70, pneumatic pressure flows through the variable orifice 48, first fluid passageway 50 and out through the line 22 to the supply line 30 of the pneumatic system 26. The restricted orifice 48, however, prevents initial surges of pneumatic pressure throughout the pneumatic system 26 during repressurization of the system 26 so that any pneumatic actuators 28 which are out of position are returned to their initial position in a controlled fashion. As the pressure on the supply line 30 to the pneumatic system 26 increases, this increased pressure is connected as a feedback signal by the line 32 to the housing pilot port 18 and thus to the control port 64 of the diaphragm actuator 62.

Whenever the pressure at the feedback port 18 exceeds a predetermined amount, as selected by the user, the diaphragm actuator 62 closes the second pneumatic valve 60. In doing so, the pressure from the source 20 actuates the first pneumatic valve 40 to its second position thus fluidly connecting the second fluid passageway 52 in series between the pneumatic source 20 and the pneumatic system 26. Since the second fluid passageway 52 is unrestricted, final pressurization of the pneumatic system 26 is rapidly achieved.

A primary advantage of the pneumatic starter device of the present invention is the provision of the user adjustable orifice 48 coupled together with the variable diaphragm actuator 62. The variable orifice 48 thus allows the user to adapt the initial speed of pressurization of the fluid system 26 in accordance with the particular needs, size and complexity of the fluid system 28. Similarly, the user adjusted diaphragm actuator 62 enables the user to adapt the point of unrestricted pressurization of the fluid system 26 in accordance with the needs, size and complexity of the particular fluid system. In some cases, unrestricted pressurization of the fluid system can occur at a low pressurization level without fear of damaging the actuators 28 or other hazards. In other cases, however, a high pressurization before switching to unrestricted pressurization is required in order to protect the actuators 28, and their associated components, from damage.

The valve 40, orifice 48, actuator 62 and valve 60 are all of a well known construction so that a further description thereof is unnecessary.

Having described my invention, however, many modifications thereto will become apparent to those skilled in the art to which it pertains without deviation from the spirit of the invention as defined by the scope of the appended claims.

I claim:

1. For use in conjunction with a source of pneumatic pressure, a pneumatic system having a pressure supply line with an inlet end and a tail end, and at least one pneumatic actuator in said fluid system, a device to control the initial pressurization of the pneumatic system comprising:

a pneumatic valve having a first and second inlet port and an outlet port, said valve being movable between a first position in which a first fluid passageway connects said first inlet port to said outlet port, and a second position in which a second fluid passageway connects said second inlet port to said outlet port, a user variable orifice connected in series between said source and said first inlet, means for connecting said source to said second inlet, means for connecting said outlet to the inlet end of the pressure supply line, means for urging said valve toward said first position, and means responsive to a pressure at the tail end of said supply line greater than a predetermined amount for moving said valve to said second position, wherein said means for variably restricting fluid flow through said first passageway comprises a variable orifice fluidly connected in series between said pneumatic pressure source and said first passageway.

2. The invention as defined in claim 1 and comprising means for varying said predetermined pressure at which said moving means moves said valve from said first to said second position.

3. The invention as defined in claim 2 wherein said valve means comprises a pilot port which, upon application of air pressure greater than a preset pressure, moves said valve from said first to said second position, and wherein said pressure varying means comprises:

a normally open second pneumatic valve connected in series between said housing inlet port and said pilot port, a diaphragm actuator fluidly connected to said tail end of said supply line, said diaphragm actuator being connected to said second pneumatic valve so that, when the pressure at said tail end of said supply line exceeds said predetermined pressure, said diaphragm closes said second valve, and means for adjusting said predetermined pressure at which said diaphragm actuator closes said second valve.

* * * * *